US008388461B1

(12) United States Patent
Martinez, Jr.

(10) Patent No.: US 8,388,461 B1
(45) Date of Patent: Mar. 5, 2013

(54) GOLF TRAINING AID USING A PROJECTED DECAL IMAGE

(76) Inventor: Emilio Martinez, Jr., San Antonio, TX (US)

( * ) Notice: Subject to any disclaimer, the term of this patent is extended or adjusted under 35 U.S.C. 154(b) by 0 days.

(21) Appl. No.: 13/136,844

(22) Filed: Aug. 12, 2011

(51) Int. Cl.
*A63B 69/36* (2006.01)

(52) U.S. Cl. ..... 473/268; 473/210; 473/409

(58) Field of Classification Search ..... 473/210, 473/211, 257, 266, 268, 278, 409
See application file for complete search history.

(56) References Cited

U.S. PATENT DOCUMENTS 3,228,696 A 1/1966 Hull
4,957,295 A 9/1990 McConkey
4,991,849 A * 2/1991 Fabanich ..... 473/210
5,413,346 A * 5/1995 Hedlund et al. ..... 473/210
6,224,492 B1 * 5/2001 Grimes ..... 473/210
7,328,997 B2 2/2008 Russomagno et al.

* cited by examiner

*Primary Examiner* — Nini Legesse
(74) *Attorney, Agent, or Firm* — Gunn, Lee & Cave, P.C.

(57) ABSTRACT

Small flexible decals having a vinyl cling membrane base layer (20) attach onto the lens of conventional spectacles forming a training aid for use in sports activities such as golf. The decals cling firmly to the spectacle lens by cling attraction and do not require an adhesive. The decals occupy a small area of the lens and are positioned directly in line between the user's eyes and visual target. This creates the appearance of a projected decal image superimposed over the visual target. In golf the projected decal image appears superimposed over the golf ball and serves as a visual aid to the golfer. In one embodiment a tinted, transparent projected decal image (18) aids a golfer to establish proper alignment at address and reveals excessive head movement during the golf stroke. In another embodiment an opaque projected decal image (19) prevents the golfer from becoming visually fixated on the golf ball, thereby reducing stress and performance anxiety.

13 Claims, 9 Drawing Sheets

GOLF TRAINING AID USING A PROJECTED DECAL IMAGE

Effective execution of many sports activities require proper physical set up prior to performing the sports action and maintaining certain features of the initial set up while performing the sports action. In golf it is important to establish correct body and eye alignment prior to initiating the golf stroke. It is also important to maintain the initial body posture and to minimize head movement during the golf stroke.

Sports psychologists agree that stress contributes to the development of performance anxiety during athletic competition. One source of stress in golf occurs when the golfer becomes visually fixated on the golf ball just before performing the golf swing. The resulting anxiety produces muscular tension which limits the golfer's ability to perform a smooth effective golf stroke.

Therefore a golf training aid is presented herein that encourages proper physical set up and swing fundamentals and in addition provides a means to reduce performance anxiety.

The prior art proposes a variety of devices to aid the golfer in establishing proper alignment and to minimize head movement during the golf swing. U.S. Pat. No. 4,957,295 (1990) to McConkey discloses a complex optical membrane that attaches to spectacle lenses which produces an undesired and disorienting magnification of the golf ball during use.

U.S. Pat. No. 7,328,997 (2008) to Russomagno et al. discloses a vision restricting method based on opaque films, which limits the golfer to using one eye. In addition the films must be custom trimmed to fit the specific spectacle lens shape being used.

U.S. Pat. No. 4,991,849 (1991) to Fabanich discloses specialized golfing spectacles with modified lenses and a complex mechanical assembly used to adjust the lens position. This mechanical assembly adds undesired weight to the spectacles. Golfers who require prescription lenses will have difficulty using these spectacles.

U.S. Pat. No. 3,228,696 (1961) to Hull also discloses specialized golfing spectacles employing a complex mechanical assembly including slotted and drilled specialty lenses. This type of aid will be costly to manufacture and will be cumbersome to adjust and use.

Research and analysis reveal that known training aids suffer from a variety of disadvantages:

a) Many aids incorporate complex mechanical assemblies with are costly to manufacture and add undesired weight, making them bulky and cumbersome to use.

b) Many aids require specialized, dedicated spectacles that cannot be used for normal daily activities.

c) Other aids provide significant vision restriction, making them unsafe for use during normal daily activities such as walking, driving a golf cart, etc.

d) Other aids provide visual magnification or demagnification resulting in an undesired alteration of depth perception.

e) Many aids are difficult to adjust and calibrate for each individual user.

f) Many aids are overly conspicuous, unattractive, and ridiculous in appearance, causing embarrassment to the user.

SUMMARY

In accordance with one embodiment a training aid comprises a pair of flat, flexible, removable, decals that attach to the lens of conventional spectacles.

ADVANTAGES

Accordingly several advantages of one or more aspects are as follows: to provide a training aid that is inconspicuous during use, lightweight, and does not require specialized spectacles, that can be easily adjusted and calibrated to individual users, that does not restrict vision during normal daily activities, that does not distort vision by magnification or demagnification, that can be used with prescription spectacles, that will provide a means to reduce performance anxiety.

DRAWINGS—FIGURES

In the drawings, closely related figures have the same number but different alphabetical suffixes.

FIG. 1 shows the training aid decals attached to the lens of conventional spectacles.

FIG. 2*a* shows the users perspective view of the tinted, transparent, projected decal image under the condition of proper alignment and no head movement.

FIG. 2*b* shows the users perspective view of the tinted, transparent, projected decal image under the condition of misalignment and excessive head movement.

FIG. 3*a* shows a training aid decal composed of a vinyl cling membrane base layer and a tinted transparent decal layer, in accordance with one embodiment.

FIG. 3*b* shows a training aid decal composed of a vinyl cling membrane base layer and an opaque decal layer, in accordance with another embodiment.

FIG. 4*a* shows the users perspective view of the opaque projected decal image under the condition of proper alignment and no head movement.

FIG. 4*b* shows the users perspective view of the opaque projected decal image under the condition of misalignment and excessive head movement.

REFERENCE NUMERALS

| | | |
|---|---|---|
| 10 spectacles | 11 tinted transparent training aid decal | |
| 13 opaque training aid decal | 14 right spectacle lens | 15 left spectacle lens |
| 16 golf ball | 18 tinted transparent projected decal image | |
| 19 opaque projected decal image | 20 vinyl cling membrane base layer | |
| 22 tinted transparent decal layer | 24 opaque decal layer | 26 ground surface |
| 28 modified spectacles | 30 golfer | 32 lined paper backing |
| 34 imaginary target line | | |

DETAILED DESCRIPTION

Figure 3A:
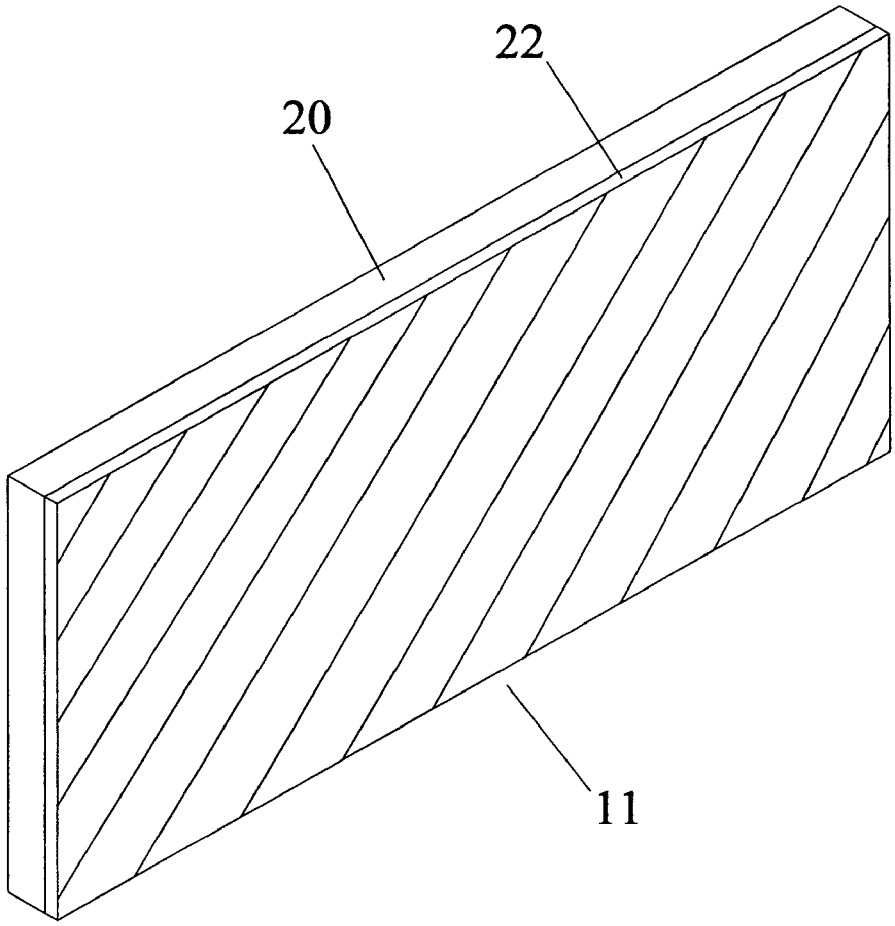

FIG. 3*a*—First Embodiment

One embodiment of the training aid decal is illustrated in FIG. 3*a*. It is composed of a tinted transparent decal layer 22 laminated onto a vinyl cling membrane base layer 20 which is then cut into a rectangular shape, producing the tinted transparent training aid decal 11. A recommended decal size is 0.2 inches wide by 0.45 inches long.

In one embodiment the tinted transparent decal layer 22 is fabricated from the medical spectral window film SOLYX: SX-RC300 available from Decorative Films, LLC. This film filters out the ultra-violet blue-green light spectrum which improves the visual contrast of the tinted, transparent, projected decal image 18 (FIGS. 2*a* and 2*b*) against a green background, such as grass. One face of this film contains a layer of clear acrylic adhesive which is used during lamination onto the membrane base layer 20.

In another embodiment the decal layer 22 is fabricated from a general purpose tinted window film that is adhesively laminated onto one face of the membrane base layer 20.

In another embodiment the decal layer 22 is fabricated from a tinted transparent adhesive backed tape that is directly applied onto one face of the membrane base layer 20.

In another embodiment decal layer 22 is directly applied onto one face of the membrane base layer 20 using a tinted transparent ink or paint and applied by one or more of the following coating means: screen printing, inkjet printing, offset lithography printing, ink roller, paint roller, ink stamp, ink brush, paint brush, spray painting, vapor deposition process, etc.

In another embodiment decal layer 22 is directly applied onto one surface of the membrane base layer 20 using a marker that produces a tinted transparent marking.

In one embodiment the vinyl cling membrane base layer 20 is fabricated from a clear transparent sheet of a commercially available vinyl based film commonly known as "Static Cling Vinyl". One side of this vinyl film contains a lined paper backing protecting a highly polished, smooth surface that clings to smooth surfaces due to cohesive forces. When this vinyl film is applied to a clean, smooth, surface it adheres firmly without the need for an adhesive. Since there is no adhesive, application and removal is easy and it can be removed and re-applied nearly indefinitely without leaving behind an adhesive residue.

In another embodiment the vinyl cling membrane base layer 20 is produced from a tinted transparent sheet of "Static Cling Vinyl". In this embodiment the tinted decal layer 22 is not required and the training aid decal 11 is formed solely by the tinted membrane base layer 20.

Figure 6:
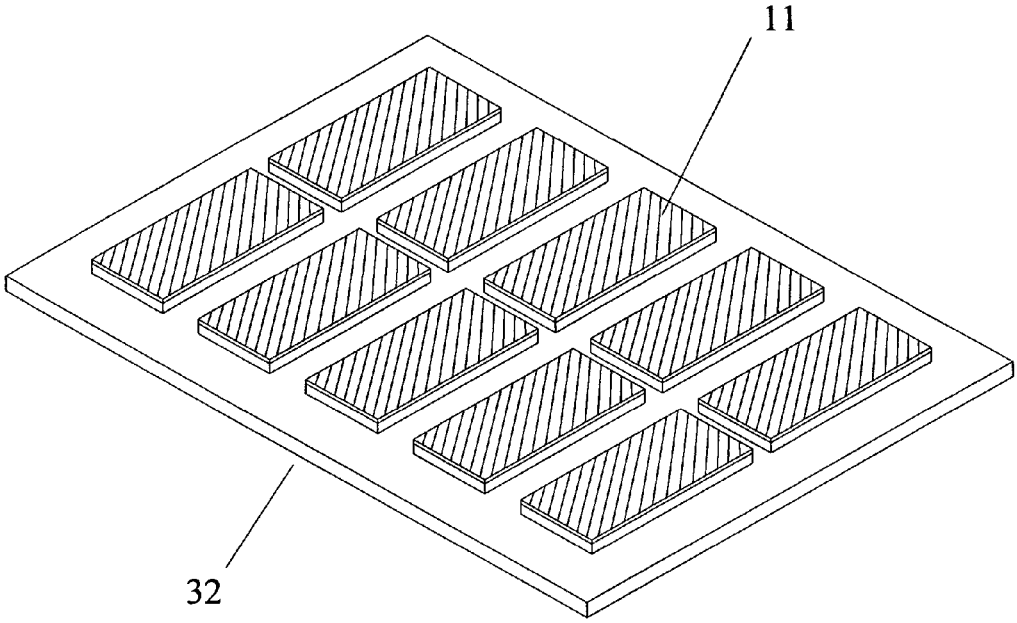
FIG. 6 shows the training aid decals supplied on a lined paper backing.

In one embodiment the training aid decals are supplied on the lined paper backing of the membrane base layer as illustrated in FIG. 6. This assembly is formed by cutting the initial lamination composed of the decal layer 22 and the paper lined membrane base layer 20 (FIG. 3*a*, Note: paper lining not shown in this figure), into a recommended sheet size of 1.25 inches wide by 1.75 inches long, then kiss cutting the training aid decals and removing the waste material. The kiss cutting process consists of cutting through the decal layer 22 and the membrane base layer 20 (FIG. 3*a*) but not the lined paper backing 32 (FIG. 6). Methods of performing the kiss cut operation include: using a die cut process, using a vinyl cutter with correct cut depth adjustment, laser cutting, etc. This assembly provides a convenient storage location for the training aid decals that is thin, lightweight, and offers organized decal access to the user.

Operation

FIG. 3*a*—First Embodiment

Figure 1:
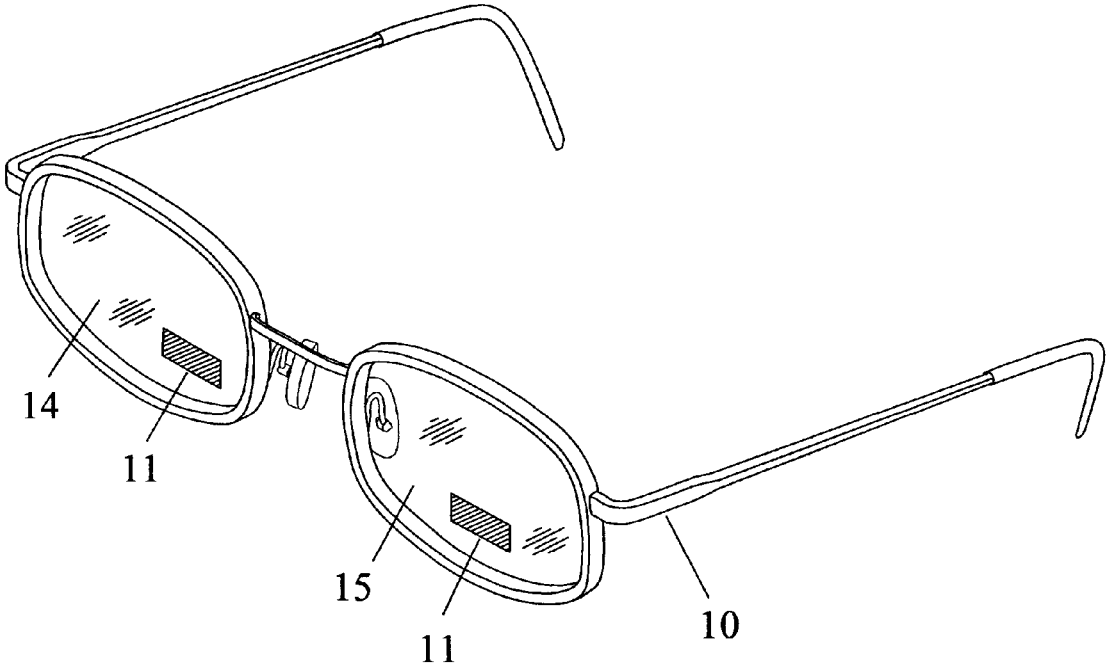

A training aid is formed by attaching a tinted transparent training aid decal 11 (FIG. 3*a*) onto each lens of conventional spectacles as shown in FIG. 1. When the decals are properly positioned and aligned on the spectacle lens the user will see a single, tinted, transparent projected decal image 18 (FIG. 2*a*) superimposed over the users visual target, such as a golf ball resting on a grass surface. The projected decal image 18 therefore provides visual feedback to the user prior to and during the golf stroke. Improper eye and body alignment prior to the golf stroke results in a projected decal image 18 that is misaligned relative to the correct imaginary target line 34 (FIG. 2*b*). This visual feedback notifies the user of incorrect alignment who then makes the corrective physical adjustments. During the golf stroke, head movement causes the projected decal image 18 to move from the original position. This visual feedback notifies the user of excessive head movement who then attempts to make the corrective adjustments. Therefore an effective visual training aid is formed from the user's conventional spectacles that is; lightweight, inconspicuous, re-usable, and is easily adjusted to individual users.

The training aid decal 11 is applied to and removed from the spectacle lens using a press on, peel off motion. It adheres firmly due to cohesive forces and does not require an adhesive. Re-application and removal can be performed nearly indefinitely without leaving behind a marring adhesive residue.

Figure 2A:
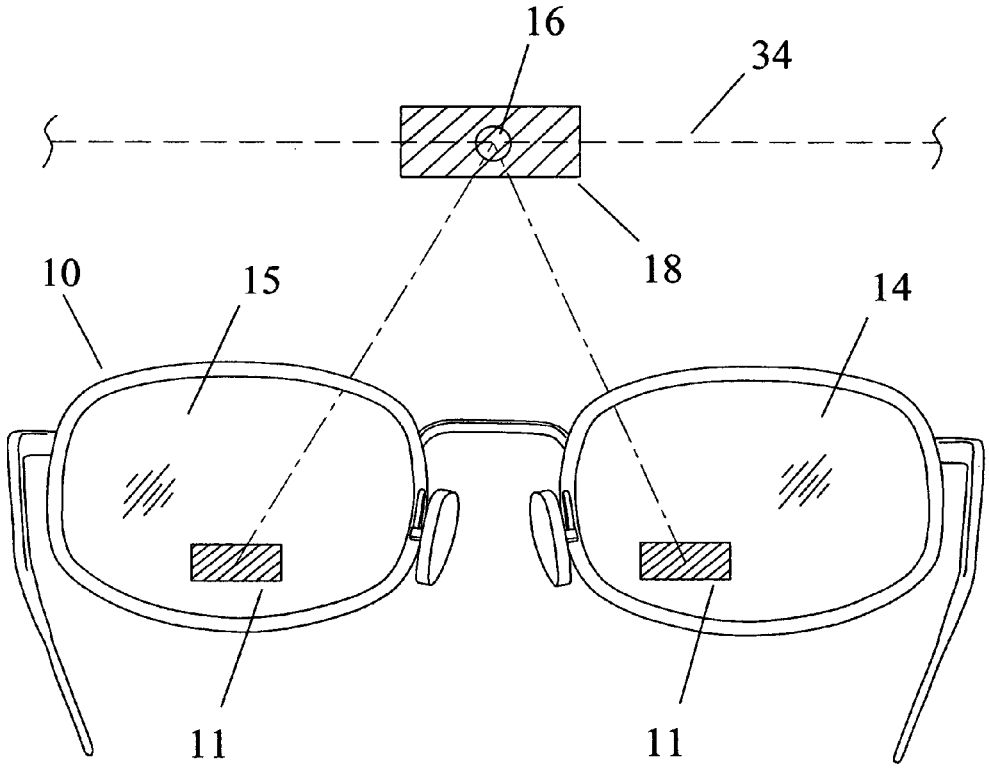
Figure 2B:
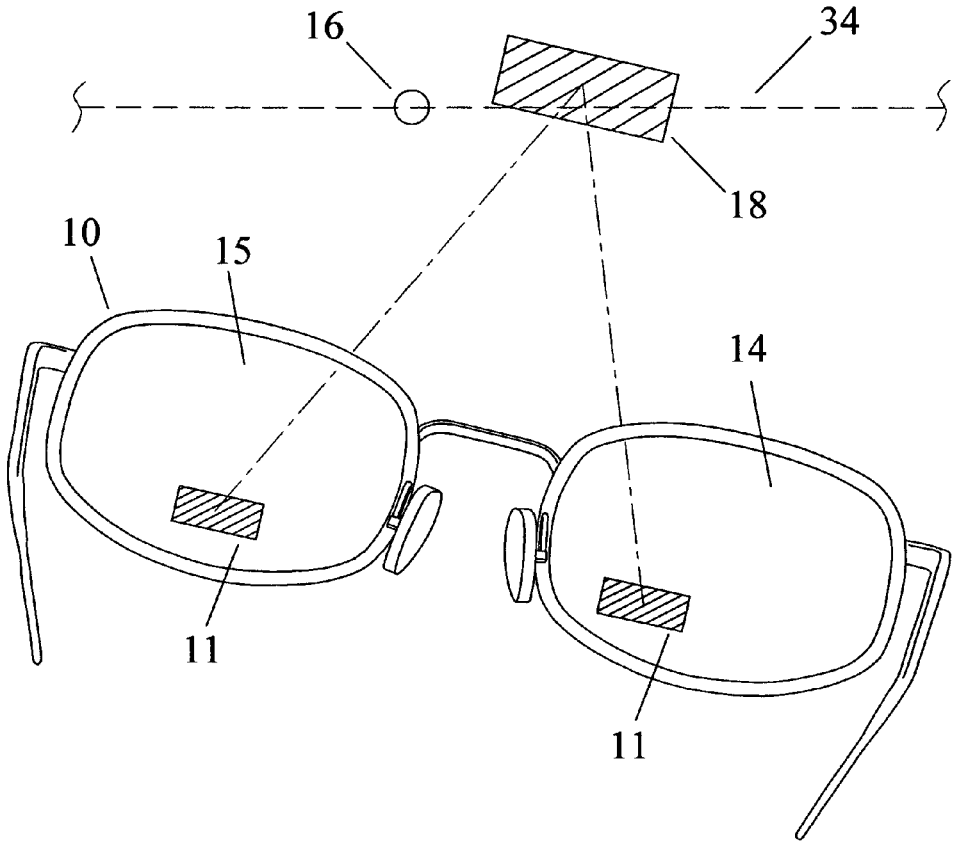

Prior to use the user must properly apply and position the training aid decal 11 to each spectacle lens as follows:

1) Using either the fingertips or non-scratch tweezers the user removes one training aid decal 11 from the lined paper backing 32 (FIG. 6) and using a press on motion applies the decal's polished bottom surface to the inside surface of spectacle lens 14 (FIG. 2*a*). The general position of the training aid decal 11 should be in the lower left area of the spectacle lens 14 as shown in FIG. 2*a*.
2) The user repeats the above procedure applying a training aid decal 11 onto the inside surface of spectacle lens 15. The general position of the training aid decal 11 should be in the lower area of the spectacle lens 15 as shown in FIG. 2*a*.
3) Wearing the spectacles, the user addresses a golf ball by placing the club head directly behind the ball and positioning his body as if he is to strike the ball. The user must insure that his posture is correct, his body and head are properly aligned, his head is tilted correctly, and that his eyes are parallel to the imaginary target line 34 (FIG. 2*a*).
4) Keeping as motionless as possible the user closes the left eye and views the golf ball with the right eye and notes the location and alignment of the projected decal image upon the ground surface. The user repeats this process, while adjusting the position of the decal on the lens 14, until the projected decal image appears directly centered over the golf ball, and is aligned parallel to the imaginary target line 34.
5) Maintaining the original address position and keeping as motionless as possible the user closes his right eye and views the golf ball with the left eye and notes the location and alignment of the projected decal image upon the ground surface. The user repeats this process, while adjusting the position of the decal on the lens 15, until the projected decal image appears directly centered over the golf ball, and is aligned parallel to the imaginary target line 34.

6) Maintaining the original address position the user now views the golf ball with both eyes open and confirms that the left and right eye projected decal images directly overlap and form a single, reinforced, projected decal image 18 (FIG. 2*a*) that is centered over the golf ball, and is aligned parallel to the imaginary target line 34. If necessary the user performs minor decal re-positioning until this result is achieved.

In accordance with one embodiment the training aid comprised of a training aid decal 11 applied onto each lens of the user's conventional spectacles can be used to improve a golfer's golf swing fundamentals. The training aid is effective on all golf swings, including: putting, chipping, pitching, partial and full iron swings, and wood swings. The training aid can be used both on the practice green and during a round of golf. Properly placed decals are located in the lower area of the spectacle lens (FIG. 2*a*) and will therefore not provide vision restriction to the user during normal activities such as walking or driving a golf cart.

Figure 5:
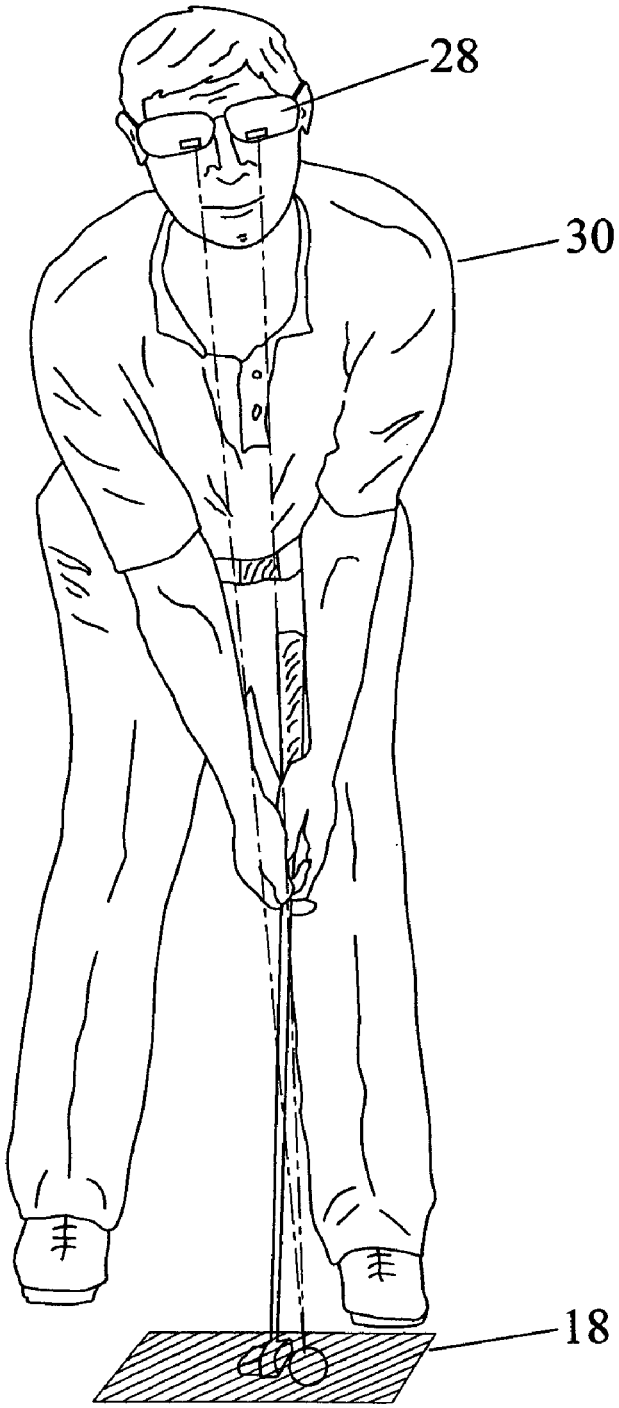
FIG. 5 shows a golfer addressing a golf ball, wearing conventional spectacles that have been modified by attaching the training aid decals to the lens, and a depiction of a visual perspective of the projected decal image.

To practice the putting stroke the user, wearing the modified spectacles 28 (FIG. 5), addresses the golf ball by placing the putter head directly behind the golf ball and then positions his body in the correct putting posture. The user insures that his body and head are properly aligned relative to the correct imaginary target line 34 (FIG. 2*a*), and that his eyes are directly over the golf ball and parallel to the target line 34. The user now tilts his head by raising or lowering his chin until the projected decal image 18 (FIG. 2*a*) is centered over the golf ball, and is parallel to the imaginary target line 34. The user proceeds to make a putting stroke while attempting to maintain the original position and alignment of the projected decal image 18 upon the ground surface. Head movement during the putting stroke causes the projected decal image 18 to move from its original position. This visual feedback is provided to the user who attempts to improve his putting technique by minimizing head movement during future putting strokes.

To practice the full golf swing the user addresses the golf ball by placing the club head directly behind the golf ball and then positions his body in the correct full swing posture. The user insures that his body and head are properly aligned relative to the correct imaginary target line 34 (FIG. 2*a*), and that his eyes are parallel to the target line 34. The user now tilts his head by raising or lowering his chin until the projected decal image 18 (FIG. 2*a*) is centered over the golf ball, and is parallel to the imaginary target line 34. The user proceeds to make a full golf swing while attempting to minimize movement of the projected decal image 18 upon the ground surface. Incorrect head and body motions during the golf swing results in excessive movement of the projected decal image 18 from its original position. This visual feedback is provided to the user who attempts to improve his golf swing technique by minimizing improper head and body motions during future golf swings.

Figure 3B:
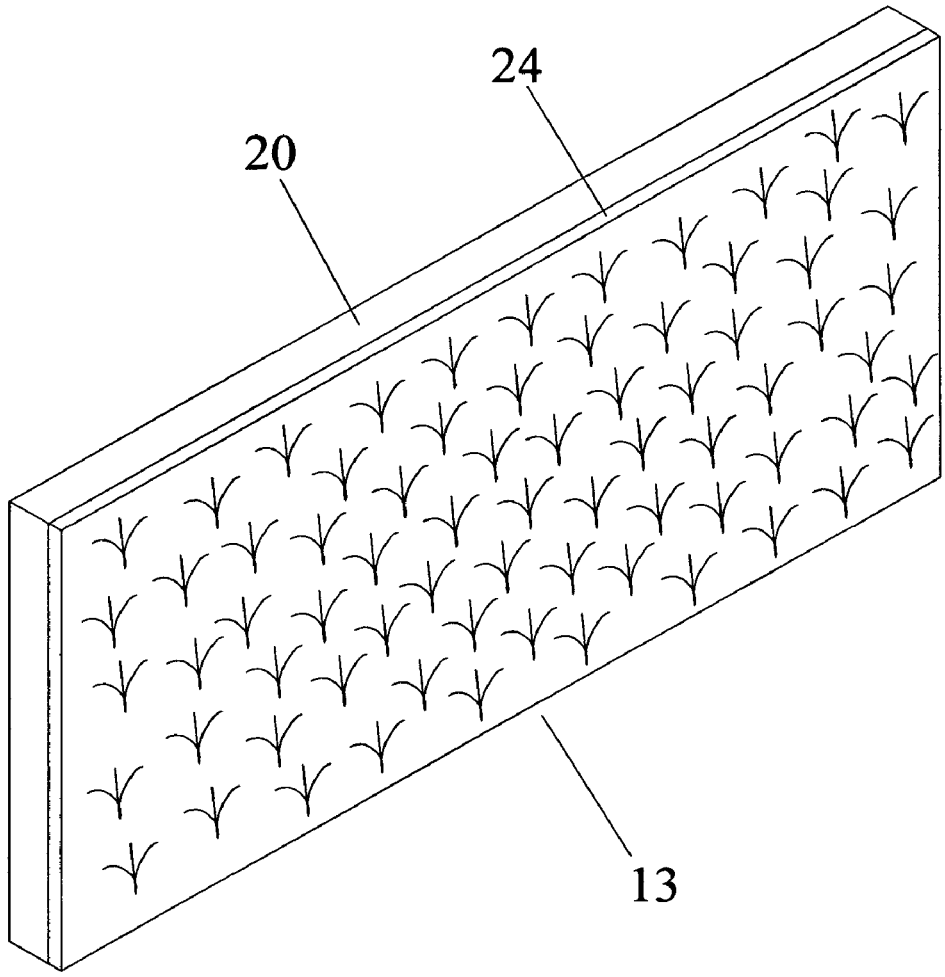

FIG. 3*b*—Alternative Embodiment

A second embodiment of the training aid decal is illustrated in FIG. 3*b*. It is composed of an opaque decal layer 24 applied onto one face of the vinyl cling membrane base layer 20 which is then cut into a rectangular shape, thereby producing the opaque training aid decal 13. A recommended decal size is 0.2 inches wide by 0.45 inches long.

Figure 4A:
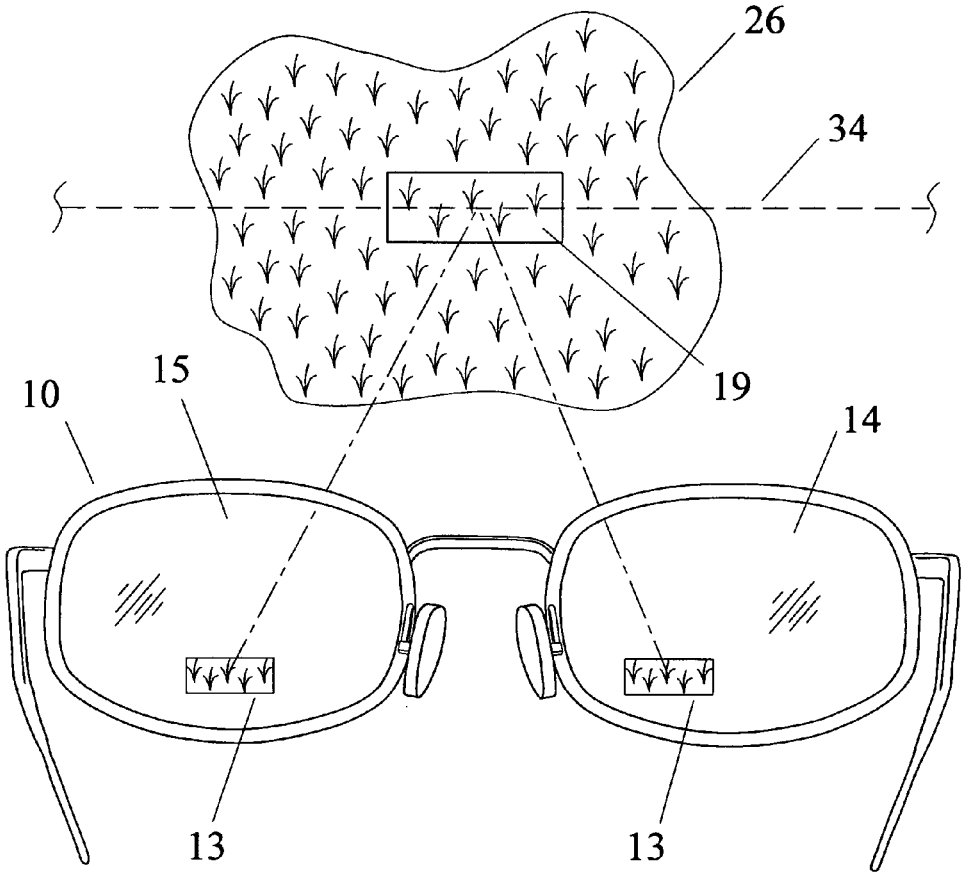
Figure 4B:
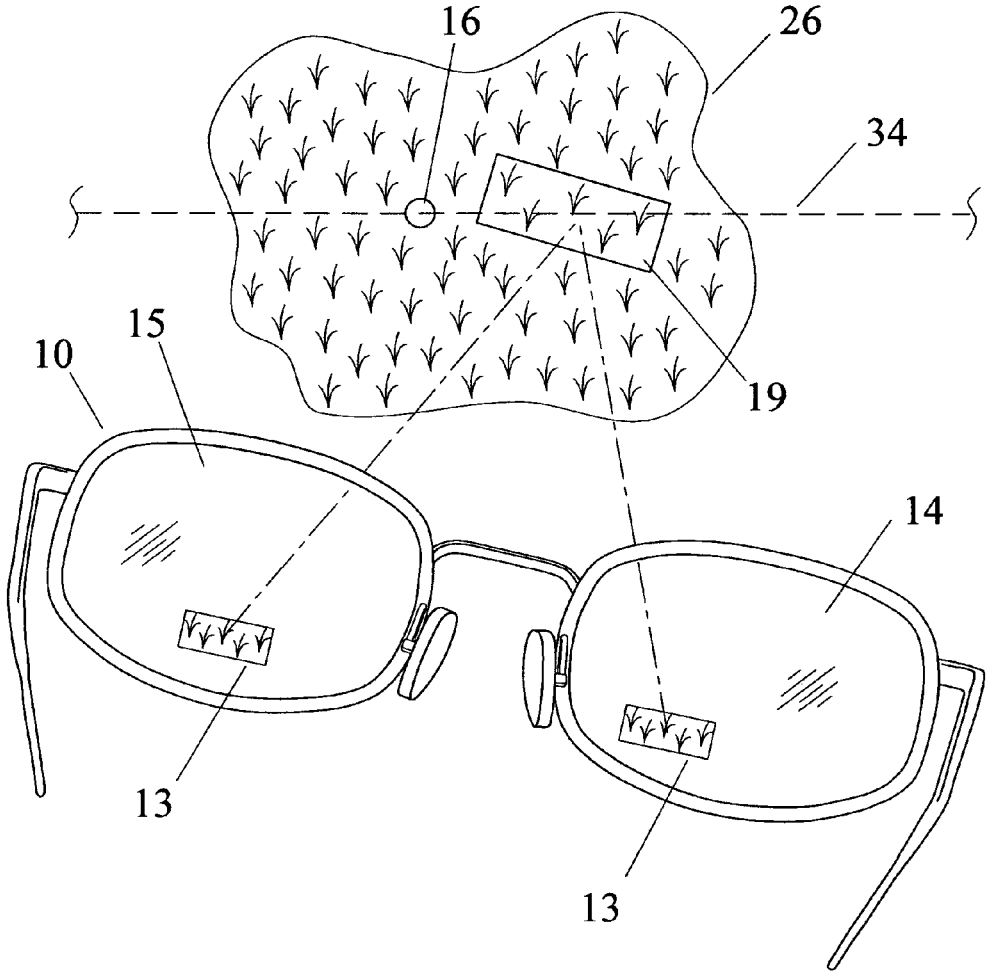

In one embodiment the opaque decal layer 24 (FIG. 3*b*) consists of a grass surface graphical image applied directly onto one face of the membrane base layer 20 using one or more opaque inks or paints, and applied by one or more of the following coating means: screen printing, inkjet printing, offset lithography printing, ink roller, paint roller, ink stamp, ink brush, paint brush, spray painting, etc. The function of the grass surface graphical image is to produce an opaque projected decal image 19 (FIG. 4*a*) that visually blends into a grass covered ground surface creating the visual effect of making a golf ball disappear. Many golfers experience stress due to becoming visually fixated on the golf ball at address and during the golf stroke. This results in performance anxiety, causing muscular tension which limits the golfer's ability to perform a smooth effective golf swing. Therefore making the golf ball disappear will reduce anxiety thus enabling golfers to perform a more effective golf stroke.

In another embodiment the opaque decal layer 24 (FIG. 3*b*) consists of an opaque uniform colored ink or paint that is directly applied onto one face of the membrane base layer 20 using one or more of the following coating means: screen printing, inkjet printing, offset lithography printing, ink roller, paint roller, ink stamp, ink brush, paint brush, spray painting, etc. The color selection may be determined from desired operating characteristics. For example; a green color may be selected to produce a projected decal image that blends into a grass covered ground surface, a red color may be selected to produce a projected decal image that contrasts with a grass covered ground surface, an amber color may be selected to produce an opaque training aid decal 13 (FIG. 3*b*) that matches the amber lens color of the users spectacles thus providing inconspicuous training aid operation.

In another embodiment the opaque decal layer 24 (FIG. 3*b*) is fabricated from an opaque colored film that is adhesively laminated onto one face of the membrane base layer 20.

In another embodiment the opaque decal layer 24 (FIG. 3*b*) is fabricated from an opaque colored adhesive backed tape that is directly applied onto one face of the membrane base layer 20.

In another embodiment the opaque decal layer 24 is directly applied onto one face of the membrane base layer 20 using a marker that produces an opaque marking.

In one embodiment the vinyl cling membrane base layer 20 is fabricated from a clear transparent sheet of a commercially available vinyl film commonly known as "Static Cling Vinyl".

In another embodiment the vinyl cling membrane base layer 20 is fabricated from a white opaque sheet of "Static Cling Vinyl".

In another embodiment the vinyl cling membrane base layer 20 is produced from an opaque colored sheet of "Static Cling Vinyl". In this embodiment the opaque decal layer 24 is not required and the training aid decal 13 is formed solely by the opaque colored membrane base layer 20.

In one embodiment the training aid decal 13 is supplied on the lined paper backing of the membrane base layer as illustrated in FIG. 6. This assembly is formed as described for the first embodiment of FIG. 3*a*.

Operation

FIG. 3*b*—Alternative Embodiment

A training aid is formed by attaching an opaque training aid decal 13 (FIG. 3*b*) to each lens of conventional spectacles as shown in FIG. 1. When the decals are properly positioned and aligned on the spectacle lens the user will see a single opaque projected decal image 19 (FIG. 4*a*) superimposed over the users visual target, such as a golf ball resting on a grass surface. The projected decal image 19 provides dual purpose visual feedback to the user prior to and during the golf stroke. The first purpose is to provide alignment and head movement feedback equivalent to that described for the first embodiment of FIG. 3*a*. The second purpose is to prevent the golfer from becoming visually fixated on the golf ball at address. Many golfers become visually fixated on the golf ball at address which leads to stress, resulting in performance anxiety. This produces muscular tension which inhibits the golfer's ability to perform an effective golf stroke. Therefore removing the golf ball from the golfer's vision reduces stress and anxiety which improves the golfer's ability to perform an effective golf stroke.

In accordance with the embodiment of FIG. 3*b* a training aid is formed from the user's conventional spectacles that provides a means to reduce performance anxiety, and that is; lightweight, inconspicuous, re-usable, and is easily adjusted to individual users.

The training aid decal 13 is applied to and removed from the spectacle lens using a press on, peel off motion as described for the first embodiment of FIG. 3*a*. Prior to use the user must properly apply and position the training aid decal 13 onto each spectacle lens. The application procedure is identical to that provided for the first embodiment of FIG. 3*a*.

To practice the putting stroke the user addresses the golf ball by placing the putter head directly behind the golf ball and then positions his body in the correct putting posture. The user insures that his body and head are properly aligned relative to the correct imaginary target line 34 (FIG. 4*a*), and that his eyes are directly over the golf ball and parallel to the target line 34. The user now tilts his head by raising or lowering his chin until the projected decal image 19 (FIG. 4*a*) is centered over the golf ball, and is parallel to the imaginary target line 34. The visual effect of making the golf ball disappear liberates the user from becoming visually fixated on the golf ball and allows him to focus on performing an effective putting stroke. The user proceeds to make a putting stroke while attempting to minimize head movement during the stroke. Head movement during the putting stroke causes the projected decal image 19 to move from its original position. This visual feedback is provided to the user who attempts to improve his putting technique by minimizing head movement during future putting strokes.

To practice the full golf swing the user addresses the golf ball by placing the club head directly behind the golf ball and then positions his body in the correct full swing posture. The user insures that his body and head are properly aligned relative to the correct imaginary target line 34 (FIG. 4*a*), and that his eyes are parallel to the target line 34. The user now tilts his head by raising or lowering his chin until the projected decal image 19 (FIG. 4*a*) is centered over the golf ball, and is parallel to the imaginary target line 34.

The visual effect of making the golf ball disappear liberates the user from becoming visually fixated on the golf ball and allows him to focus on performing an effective golf swing. The user proceeds to make a full golf swing while attempting to minimize improper head and body movement during the swing. Incorrect head and body motions during the golf swing results in excessive movement of the projected decal image 19 from its original position. This visual feedback is provided to the user who attempts to improve his golf swing technique by minimizing improper head and body motions during future golf swings.

CONCLUSIONS, RAMIFICATIONS, AND SCOPE

Accordingly, the reader will see that the training aid decals of the various embodiments can be used to form a training aid from conventional spectacles that is lightweight, unobtrusive, re-usable, and easily adjustable, Although the description above contains many specificities, these should not be construed as limiting the scope of the embodiments but as merely providing illustrations of some of several embodiments. For example, the decals can have other shapes, such as circular, oval, square, trapezoidal, etc. The decals can have other coloring schemes such as multi-tone or multi-hued coloring. The decals can have other graphical images such as soil images, dormant grass images, camouflage pattern images, etc. The decals can be produced in smaller and larger sizes.

Thus the scope of the embodiments should be determined by the appended claims and their legal equivalents, rather than by the examples given.

I claim:

1. A golf training system for attachment to an article of eyewear having first and second lenses, said system comprising:

a pair of decals attachable to said first and second lenses;

wherein each decal of said pair of decals has a perimeter and comprises a base layer and a tinted layer having a tinted-layer perimeter, said base layer having a first side with a first surface area adherable to said lenses and a second side with a second surface area opposite said first side, said second surface area of said second side being adhered to a surface of said tinted layer; and, wherein the perimeter of each decal is identically shaped and equal to the tinted-layer perimeter of its tinted layer.

2. The golf training system of claim 1 wherein said tinted layer allows light to be transmitted therethrough.

3. The golf training system of claim 1 wherein the second surface area of each base layer of each decal has a perimeter identically shaped and equal to the tinted-layer perimeter of the tinted layer to which it is adhered.

4. The golf training system of claim 1 wherein the perimeter of one decal in said pair of decals is identical to the perimeter of the other decal in said pair of decals.

5. A golf training system for attachment to an article of eyewear having first and second lenses, said system comprising:

a first decal having a first side and an opposing second side, said first decal having a substantially uniform optical transmittance for light passing between said first side and said second side, said first decal being attachable to said first lens of said article of eyewear;

a second decal having a first side and an opposing second side, said second decal having a substantially uniform optical transmittance for light passing between said first side and said second side, said second decal being attachable to said second lens of said article of eyewear; and, wherein said optical transmittance of said first decal is at least substantially similar to said optical transmittance of said second decal.

6. The golf training system of claim 5 wherein said first decal and said second decal are tinted and are positionable on said first and second lenses so that a user sees only a single projected image superimposed over a visual target when said user focuses on said visual target through said first and second decals.

7. The golf training system of claim 6 wherein said single projected image aligns parallel to an imaginary target line along a swing path of a golf club.

8. The golf training system of claim 5 wherein said first decal and said second decal each comprises a tinted layer having a first surface with a first surface area and an adhesive base layer having a second surface with a second surface area, said first surface area of said tinted layer being attached to said second surface area of said adhesive base layer, and, wherein the first and second surface areas are equal and are identically shaped.

9. The golf training system of claim 5 wherein said first decal and said second decal each comprises a light filter which prohibits preselected wavelengths of visible light from being transmitted therethrough.

10. The golf training system of claim 9 wherein said preselected wavelengths of light are selected from the group consisting of green visible light, blue visible light, and violet visible light.

11. The golf training system of claim 5 wherein said first decal and said second decal are transparent.

12. The golf training system of claim 5 wherein said first decal and said second decal are tinted darker than the lenses of said article of eyewear.

13. A golf training system for attachment to an article of eyewear having first and second lenses, said system comprising:

a first flexible decal comprising a first side and a second side opposite of said first side, said first side being adherable to said first lens and wherein said second side consists of an area of substantially uniform optical transmittance for light passing therethrough;

a second flexible decal comprising a first side and a second side opposite of said first side, said first side being adherable to said second lens and wherein said second side consists of an area of substantially uniform optical transmittance for light passing therethrough; and, wherein said optical transmittance of said first flexible decal is at least substantially similar to said second flexible decal.

* * * * *